United States Patent [19]

Boynton

[11] 4,254,602

[45] Mar. 10, 1981

[54] TRASH BAG FILLING DEVICE

[76] Inventor: Wilson C. Boynton, 178 Madison Ave., Holyoke, Mass. 01040

[21] Appl. No.: 973,915

[22] Filed: Dec. 28, 1978

Related U.S. Application Data

[63] Continuation-in-part of Ser. No. 898,477, Apr. 20, 1978, abandoned.

[51] Int. Cl.[3] ..... B65B 67/04

[52] U.S. Cl. ..... 53/390; 220/1 T

[58] Field of Search ..... 53/390, 392, 459, 570; 220/1 T, DIG. 14

[56] References Cited

U.S. PATENT DOCUMENTS

| | | | |
|---|---|---|---|
| 78,433 | 6/1868 | Crandall | 141/390 |
| 545,662 | 9/1895 | Stewart | 220/1 T |
| 579,228 | 3/1897 | Frame | 220/1 T |
| 579,907 | 3/1897 | Toal | 220/1 T |
| 705,672 | 7/1902 | Hughes | 220/1 T |
| 745,322 | 12/1903 | Burrough | 220/1 T |
| 1,104,055 | 7/1914 | Lowe | 220/1 T X |
| 1,131,102 | 3/1915 | Aldrich | 220/1 T |
| 1,521,414 | 12/1924 | Arcaro | 220/1 T |
| 1,875,813 | 9/1932 | Kaplan et al. | 220/1 T X |
| 1,879,410 | 9/1932 | Morris et al. | 141/390 X |
| 2,757,500 | 8/1956 | Heinl et al. | 53/292 X |
| 3,235,119 | 2/1966 | Smith | 220/1 T X |
| 3,342,368 | 9/1967 | Matry | 220/1 T |
| 4,014,157 | 3/1977 | Pearce | 53/459 |
| 4,037,778 | 7/1977 | Boyle | 53/390 X |

*Primary Examiner*—Horace M. Culver

*Attorney, Agent, or Firm*—Chapin, Neal & Dempsey

[57] ABSTRACT

A trash bag filling device comprises a container having a base provided with air passages therethrough and an integral handle and further comprises a rigid frustoconical sidewall structure upstanding from the base. Alternatively, the air passages may be provided in the sidewall adjacent the base. Trash received within the device may be compressed therewithin, thereby forming a compacted plug of material having a tapered shape. The basal air passages prevent the creation of a vacuum between the trash and the base for ease in emptying the device into a trash bag. The tapered shape of the plug allows a bag in which the plug is received to be easily closed and tied without tearing.

3 Claims, 7 Drawing Figures

TRASH BAG FILLING DEVICE

BACKGROUND

This is a continuation-in-part of application Ser. No. 898,477, filed Apr. 20, 1978 and now abandoned.

This invention relates to trash bag filling devices and particularly trash bag filling devices in which trash may be compacted prior to disposal in a bag.

Plastic trash bags have in recent years achieved a widespread popularity for the disposal of trash such as lawn and hedge clippings, twigs, leaves and the like. While such trash bags exhibit a convenience of disposability with the trash they contain, they are somewhat inconvenient to use in that they are formed from thin gauge plastic and hence are not self-supporting in an open upright condition for filling. Thus, a user heretofore had to hold the bag open while filling, a procedure often awkward and difficult to carry out, particularly in outdoor use such as in the collection of yard clippings, twigs and the like. Furthermore, the thin gauge plastic from which such trash bags are constructed is easily torn by sharp objects, particularly when the user compacts trash within the bag during the filling thereof.

In an effort to render plastic trash bags more convenient to use, various bag holders and rigid liners have been proposed. One type of known bag holder comprises a frame having upright legs fixed thereto, the mouth of a trash bag being held open by the frame and the legs serving to maintain the bag in an upright orientation. While such devices adequately maintain a trash bag in an open condition, they are often inconvenient to set up and load with fresh bags and provide no lateral support required for trash compaction within the bag.

Open ended rigid bag liners, such as those disclosed in U.S. Pat. Nos. 3,915,329 to Zaks and 4,014,157 to Pearce are adapted for insertion into the trash bag for the filling thereof. Although such liners afford lateral support for the trash bag, they provide no support for the bottom of the bag which is easily torn by sharp objects during compaction of the trash as set forth hereinabove. Moreover, such liners often require additional apparatus such as clamp rings or covers for maintenance of the bag in an upright orientation and, therefore, may be inconvenient to use.

While trash may be compacted in an ordinary trash can, such cans are not easily emptyable into a bag due to the creation of a vacuum between the compacted trash and the can bottom, which vacuum hinders the removal of the trash from the can bottom.

Accordingly, it is a principal object of the present invention to provide a trash bag filling device which overcomes the deficiencies of the prior art.

It is another object to provide a trash bag filling device in which trash may be compacted without an attendant tearing of a trash bag.

It is another object of the present invention to provide a trash bag filling device from which compacted trash is easily emptyable into a bag.

It is another object of the present invention to provide a trash bag filling device which is convenient to use and economic to construct.

DESCRIPTION OF THE DRAWINGS

These and other objects will become more readily apparent from the following detailed description taken in connection with the accompanying drawings, in which.

DESCRIPTION OF THE PREFERRED EMBODIMENT

Figure 1:
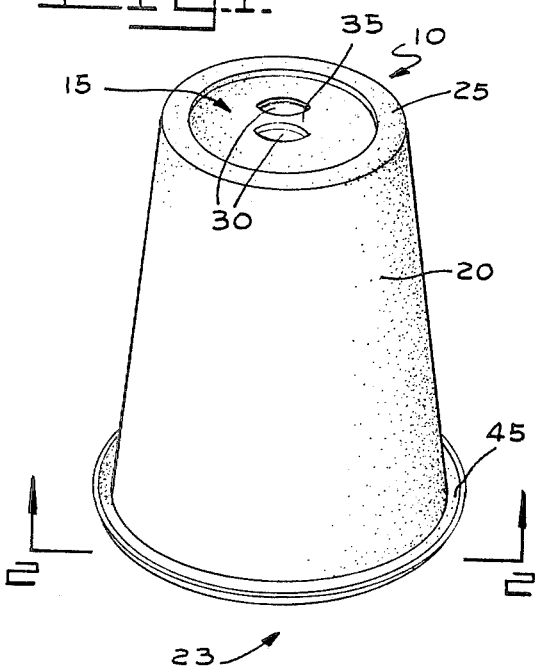
FIG. 1 is a three dimensional view of the trash bag filling device of the present invention.
Figure 2:
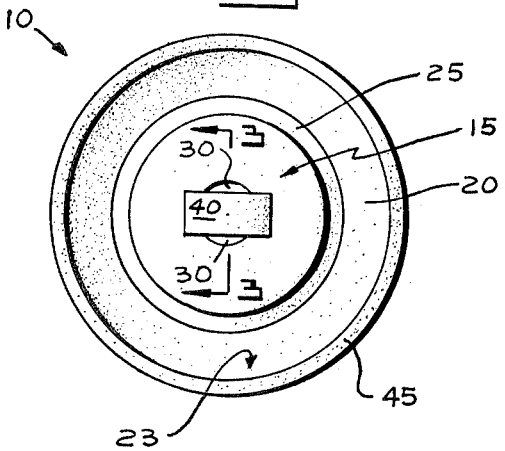
FIG. 2 is an end view of the trash bag filling device taken in the direction of line 2—2 of FIG. 1.
Figure 3:
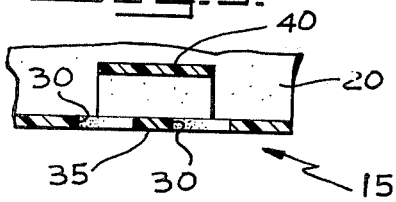
FIG. 3 is a sectional view of the device taken in the direction of line 3—3 of FIG. 2.

Referring to the drawings, the trash bag filling device of the present invention is indicated generally at 10 and comprises a base 15 and a rigid sidewall structure 20 upstanding from the base and defining mouth 23, the base and the adjacent portion of the sidewall defining a "basal portion" of the device. The base and sidewall are formed from any material of suitable rigidity such as sheet steel or various synthetic plastics such as high density polyethylene and the like and may be formed separately and attached together by any known technique or formed integrally as by molding or sheet metal fabrication techniques.

As shown, base 15 comprises a circular, generally planar member formed with a peripheral reinforcing rib 25, but as will be appreciated, may be of various other outlines and may be ribbed in any desired pattern for enhanced strength. The basal portion is provided with vents or air passages 30 in base 15 which prevent the creation of a vacuum between trash compacted in the device and the device itself. The vents are of a size, number and location determined by the contemplated use of the apparatus. Where the apparatus is to be used primarily outdoors for yard work or the like, where slight spillage is not a major consideration, the vents may be formed by a pair of generally centrally disposed, spaced cutouts each dimensioned so as to define handle 35 therebetween. Handle 35 is thus integral with base 15 and in the preferred embodiment generally coplanar therewith and in use is grasped such that portions of the user's hand are received within the cutouts or vents. The interior of the base is provided with a shield 40 of any suitable material fixed to the base between vents 30 and overlying handle 35. The shield prevents trash in the container from fouling the handle.

Sidewall structure 20 upstanding from the periphery of the base comprises, in the preferred embodiment a continuous frustoconical surface having an outturned lip or flange 45 about the free edge thereof. Of course, wall 20 may be of various shapes divergent from the base as determined by the outline of the base and in use, may be ribbed for enhanced strength.

Figure 4:
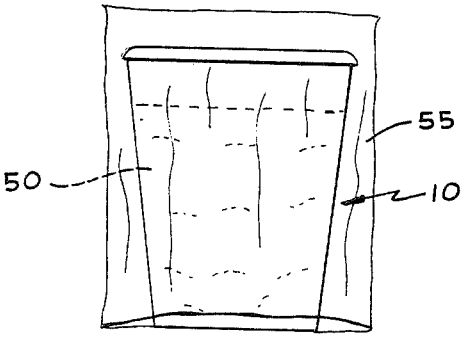
FIGS. 4 through 6 are simplified illustrations of a method of using the trash bag filling device of the present invention.
Figure 5:
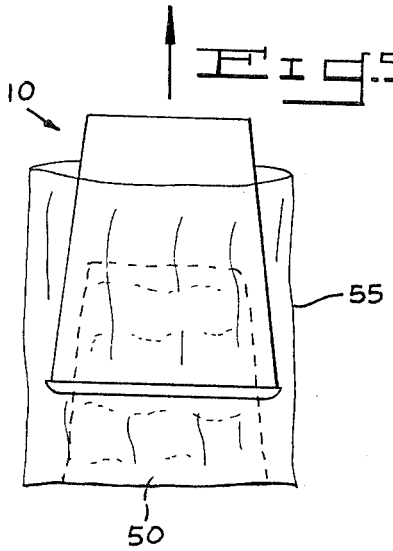
Figure 6:
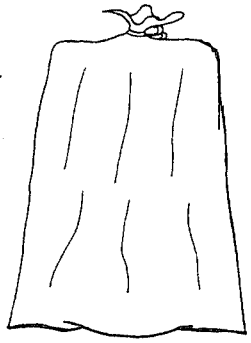

Referring to FIGS. 4, 5 and 6, the trash bag filling device of the present invention is stood upright (inverted from the orientation shown in FIG. 1) and filled to any desired extent with trash 50. The rigidity of the container allows trash therein to be compacted into a substantially cohesive plug as by pressure applied by the user. Shield 40 prevents substantially all fouling of handle 35 by the trash.

Once the device is filled and the trash suitably compacted, a standard thin gauge trash bag 55 is positioned over the mouth of device 10 and the bag and filling device are inverted in unison to the positions occupied in FIG. 5. This inversion is easily achieved by a rolling of the filling device on the base and a portion of the sidewall without a lifting of the device off the ground or other supporting surface. The cohesiveness of the trash formed into the plug and the disposition of bag 50 over the filling device militate against unwanted spillage as the device and bag are inverted. The static electrical properties of the plastic of bag 50 will often cause the bag to cling to the filling device for an enhanced prevention of unwanted spillage.

Once the filling device and bag are inverted, the filling device is easily lifted off the trash plug as shown in FIG. 5 due to the prevention by vents 30 of any vacuum formation between the trash and base 15. With the container removed the trash is received solely within the bag which may then be easily secured closed by typing or equivalent techniques (FIG. 6). The tapered shape of the plug renders convenient the gathering of the bag at the mouth thereof for closing. Owing to the extensive compaction which may be accommodated by device 10, many sharp edges of trash 55 will have been broken away from the edge of the plug, thereby reducing the risk of the tearing of bag 55 by the contents.

Figure 7:
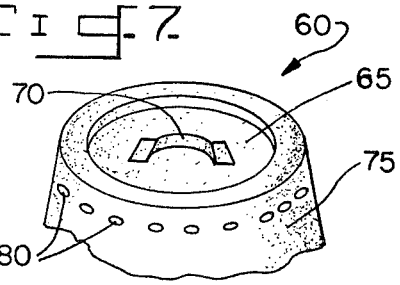
FIG. 7 is a three dimensional fragmentary view of an alternate embodiment of the trash bag filling device of the present invention.

Referring to FIG. 7, an alternate embodiment of the trash bag filling device is shown generally at 60. Filling device 60 includes a base 65 similar to base 15 with the exception that base 65 is provided with no air passages or vents and thus includes a handle which requires no exision of material from the base. Thus, handle 70 may comprise, for example, a simple strap fastened at the ends thereof to the base by riveting, fusion, bonding or equivalent techniques. Filling device 60 also includes a generally frusto conical sidewall 75 upstanding from the periphery of the base and may also include an outturned lip or flange (not shown) about the free edge thereof. Sidewall 75 adjacent its junction with base 65 is provided with a plurality of small air passages or vents 80 which function as vents 30 preventing the creation of a vacuum between the device and trash compacted therein. Such a disposition of vents is useful where, for example, the trash compacted includes small, somewhat dense objects which would drop out of the device through larger vents disposed in the base. Filling device 60 is employed in precisely the same manner as device 10 described above.

I claim:

1. A trash bag filling device comprising a container adapted to receive trash, said container comprising:

(a) a plastic planar base;

(b) a plastic, rigid sidewall extending from said base;

(c) said base being provided with a pair of spaced adjacent apertures disposed generally in a central portion of said base, said apertures being adapted in size to each receive a plurality of fingers of a user of the device and to define a handgrip in base material between the apertures, said apertures preventing the creation of a vacuum between said container and trash disposed therein for ease in emptying trash from said device into a trash bag; and, (d) a shield disposed within the interior of the container, fixed to the base, spaced from and overlying at least a portion of the apertures for preventing the fouling of said apertures by trash within said container, whereby the shield ensures that a user can insert a portion of his hand into the apertures even when the container is filled with trash.

2. The trash bag filling device according to claim 1 wherein said sidewall is divergent from said base whereby trash compacted within said device is shaped into a tapered plug.

3. The trash bag filling device according to claim 2 wherein said sidewall is generally frustoconical.

* * * * *